United States Patent [19]

Mayer et al.

[11] 3,993,852

[45] Nov. 23, 1976

[54] PROCESS FOR FLAMEPROOFING ORGANIC FIBER MATERIALS BY THE TRANSFER PROCESS

[75] Inventors: Fritz Mayer, Haltingen, Germany; Jörg Kern, Oberwil; Hermann Nachbur, Dornach, both of Switzerland

[73] Assignee: Ciba-Geigy AG, Basel, Switzerland

[22] Filed: June 18, 1974

[21] Appl. No.: 480,339

[30] Foreign Application Priority Data

June 22, 1973 Switzerland ..... 9187/73
July 26, 1973 Switzerland ..... 10926/73

[52] U.S. Cl. ..... 428/921; 8/2.5 A; 101/470; 427/248 R

[51] Int. Cl.[2] ..... C23C 11/00; C09K 3/28

[58] Field of Search ..... 117/136; 252/8.1; 106/15 FP; 427/390, 394, 248; 8/2.5 A; 156/230; 101/470; 428/921

[56] References Cited

UNITED STATES PATENTS

| | | | |
|---|---|---|---|
| 3,559,317 | 2/1971 | Knight et al. | 117/3.2 |
| 3,645,936 | 2/1972 | Gardner | 117/136 |
| 3,650,820 | 3/1972 | DiPietro et al. | 117/136 |
| 3,660,582 | 5/1972 | DiPietro et al. | 117/136 |
| 3,666,402 | 5/1972 | Meyers et al. | 117/136 |
| 3,707,346 | 12/1972 | Markert et al. | 8/2.5 |
| 3,715,310 | 2/1973 | Butcher | 117/136 |
| 3,915,628 | 10/1975 | Bossard et al. | 8/2.5 |

FOREIGN PATENTS OR APPLICATIONS

| | | |
|---|---|---|
| 1,243,219 | 8/1971 | United Kingdom |

*Primary Examiner*—Michael R. Lusignan
*Attorney, Agent, or Firm*—Joseph G. Kolodny; Edward McC. Roberts; Prabodh I. Almaula

[57] ABSTRACT

New phosphorus compounds are provided which correspond to the formula

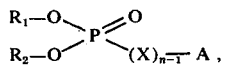

wherein $R_1$ and $R_2$ each denote alkyl with 1 to 6 carbon atoms, X denotes alkylene with 1 to 4 carbon atoms and A denotes phenyl substituted by hydroxyl, alkoxy with 1 to 4 carbon atoms, alkoxy carbonyl with 2 to 5 carbon atoms, phenyl or halogen and *n* is 1 or 2. These compounds are useful as flameproofing agents for organic fiber material, especially for polyamide, polyacrylonitrile or linear polyester fibers, when applied according to the dry thermal transfer process.

11 Claims, No Drawings

PROCESS FOR FLAMEPROOFING ORGANIC FIBER MATERIALS BY THE TRANSFER PROCESS

The subject of the invention is a process for flameproofing organic fibre material by the dry thermal transfer process, characterised in that a preparation which contains at least a. a phosphorus compound of the formula

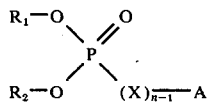

(1)

wherein $R_1$ and $R_2$ denote alkyl with 1 to 6 carbon atoms, X denotes alkylene with 1 to 4 carbon atoms and A denotes phenyl, or phenyl substituted by hydroxyl, alkoxy with 1 to 4 carbon atoms, alkyl with 1 to 4 carbon atoms, alkoxycarbonyl with 2 to 5 carbon atoms, phenyl or halogen, and *n* is 1 or 2, b. optionally a binder which is stable below 250° C and c. optionally a solvent is applied to an inert carrier and is optionally dried, the carrier is then brought into contact with the surface of the fibre material which is to be flameproofed, thereafter the carrier and the material to be finished are subjected to a heat treatment at not less than 80° C, if appropriate with use of mechanical pressure, until the phosphorus compound has been transferred to the fibre material, and the finished material is then separated from the carrier.

Particularly suitable phosphorus compounds are those of the formula

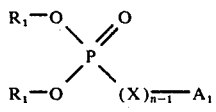

(2)

wherein $A_1$ denotes phenyl or phenyl substituted by hydroxyl or alkoxycarbonyl with 2 to 5 carbon atoms and $R_1$, X and *n* have the indicated meaning.

Phosphorus compounds particularly suitable for the process according to the invention are those of the formula

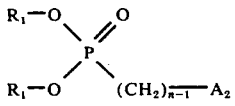

(3)

wherein $A_2$ denotes phenyl, hydroxyphenyl, alkoxycarbonylhydroxyphenyl or hydroxydiphenyl and $R_1$ and *n* have the indicated meaning.

Advantageous results are obtained above all with phosphorus compounds of the formula

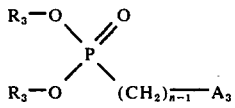

(4)

wherein $R_3$ denotes methyl or ethyl, *n* denotes 1 or 2 and $A_3$ denotes phenyl, 3-methoxycarbonyl-4-hydroxyphenyl or 3-phenyl-4-hydroxyphenyl.

Compounds of the formula (1) which are suitable above all are, for example, the following phosphorus compounds:

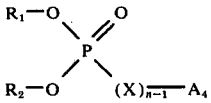

(5)

wherein $R_1$ and $R_2$ each denote alkyl with 1 to 6 carbon atoms, X denotes alkylene with 1 to 4 carbon atoms and $A_4$ denotes phenyl substituted by hydroxyl, alkoxy with 1 to 4 carbon atoms, alkyl with 1 to 4 carbon atoms, alkoxycarbonyl with 2 to 5 carbon atoms, phenyl or halogen, and *n* is 1 or 2.

Particularly suitable phosphorus compounds are those of the formula

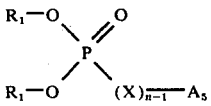

(6)

wherein $A_5$ denotes phenyl substituted by hydroxyl or alkoxycarbonyl with 1 to 5 carbon atoms and $R_1$, X and *n* have the indicated meaning.

Phosphorus compounds which are in particular suitable for the process according to the invention are those of the formula

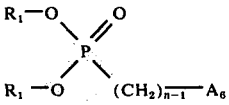

(7)

wherein $A_6$ denotes hydroxyphenyl, alkoxycarbonylhydroxyphenyl or hydroxydiphenyl and $R_1$ and *n* have the indicated meaning.

Advantageous results are achieved above all with phosphorus compounds of the formula

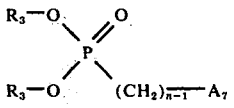

(8)

wherein $R_3$ denotes methyl or ethyl, *n* denotes 1 or 2 and $A_7$ denotes 3-methoxycarbonyl-4-hydroxyphenyl or 3-phenyl-4-hydroxyphenyl.

Examples of suitable compounds of the formula (1) are the following phosphorus compounds:

(9.1)

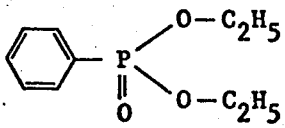

(9.2)

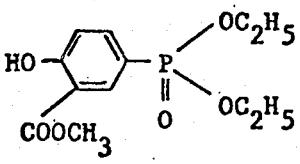

(9.3)

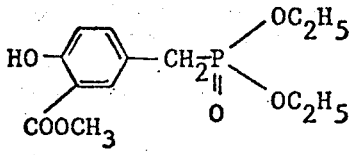

(9.4)

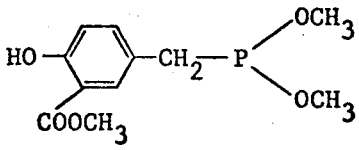

(9.5)

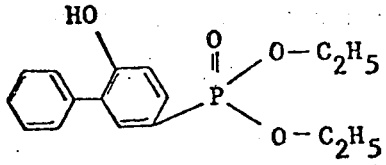

(9.6)

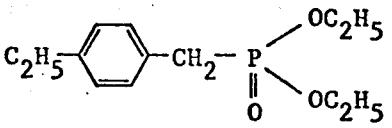

(9.7)

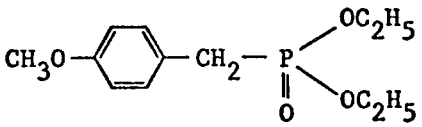

(9.8)

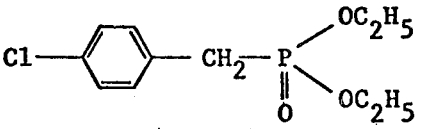

Amongst these, the compound of the formula (9.2) is particularly preferred.

$R_1$ and $R_2$ in the formulae (1), (2), (3), (5), (6) and (7) preferably represent alklyl with 1 to 4 carbon atoms. For example, $R_1$ and $R_2$ each denote n-hexyl, n-butyl, tert. butyl, isopropyl, n-propyl and especially ethyl or methyl.

A is phenyl or, in particular, a substituted phenyl radical. For example, A represents toluyl, phenyl or, above all, 4-hydroxyphenyl, 3-methoxycarbonylphenyl, 3-phenyl-4-hydroxy-phenyl, cresyl, chlorophenyl or bromophenyl or, in particular, 3-methoxycarbonyl-4-hydroxy-phenyl.

X preferably represents methylene, but radicals such as ethylene, n-propylene or n-butylene are also possible.

The compounds of the formulae (1) and (2) are known or are manufactured according to methods which are in themselves known, for example by reaction of the corresponding benzoic acid ester with a corresponding phosphite.

In particular, the compounds which are unsubstituted in the phenyl nucleus are known, whilst the compounds which are substituted in the phenyl nucleus are new but can be manufactured according to known methods.

Accordingly, a further subject of the invention are the new phosphorus compounds of the formulae (5), (6), (7), (8) and especially (9.2).

A further subject of the invention relates to a process for the manufacture of phosphorus compounds of the formula (5), characterised in that a compound of the formula (10)

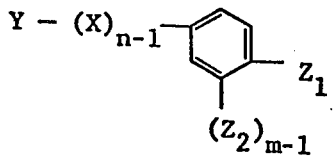

wherein X denotes alkylene with 1 to 4 carbon atoms, Y denotes halogen, $Z_1$ and $Z_2$ each denote alkoxy with 1 to 4 carbon atoms, alkyl with 1 to 4 carbon atoms, alkoxycarbonyl with 1 to 5 carbon atoms, phenyl, halogen or an optionally acylated hydroxyl group with 2 to 5 carbon atoms in the acyl radical, and *m* and *n* are 1 or 2, is reacted with a phosphite of the formula

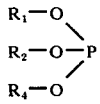

(11a)

wherein $R_1$, $R_2$ and $R_4$ each denote alklyl with 1 to 6 carbon atoms, in the melt at 100° to 180° C, and, if *n* is 1, a divalent nickel halide is co-used as the catalyst, and, if relevant, the acylated hydroxyl groups of the phosphorus compound obtained are subsequently hydrolysed.

To manufacture the phosphorus compounds of the formula (6), compounds of the formula (12)

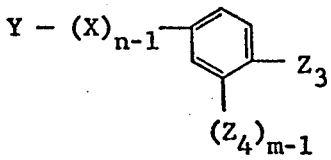

are employed, wherein $Z_3$ and $Z_4$ each denote alkoxycarbonyl with 2 to 5 carbon atoms or an optionally acylated hydroxyl group with 2 to 5 carbon atoms in the acyl radical and X, Y, *m* and *n* have the indicated meaning.

To manufacture the phosphorus compounds of the formula (7), compounds of the formula (13)

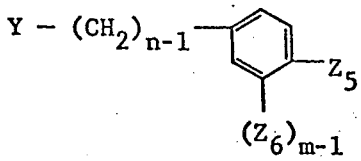

are employed, wherein Y denotes halogen, *m* and *n* each denote 1 or 2, $Z_6$ denotes alkoxycarbonyl with 2 to 5 carbon atoms or phenyl and, if $Z_6$ is alkoxycarbonyl and $m$ is 2, $Z_5$ denotes a free hydroxyl group, or, if $Z_6$ is phenyl and $m$ is 2 or if $m$ is 1, $Z_5$ denotes an acylated hydroxyl group with 2 to 5 carbon atoms in the acyl radical.

To manufacture the phosphorus compounds of the formula (8) compounds of the formula

(14) 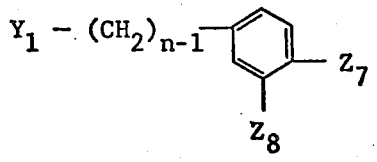

are employed, wherein $Y_1$ is chlorine or bromine, $n$ is 1 or 2, $Z_8$ is phenyl or methoxycarbonyl and, if $Z_8$ is methoxycarbonyl, $Z_7$ is hydroxyl or, if $Z_8$ is phenyl, $Z_7$ denotes acetyl.

5-Bromo-2-hydroxy-benzoic acid methyl ester is employed for the manufacture of the compound of the formula (9.2).

To manufacture the compounds of the formulae (6) and (7), phosphites of the formulae

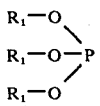

(15)

are employed, wherein $R_1$ denotes alkyl with 1 to 6 carbon atoms.

To manufacture the compounds of the formula (8), phosphites of the formula

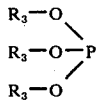

(16)

are employed, wherein $R_3$ denotes methyl or ethyl.

To manufacture the compound of the formula (9.2), triethyl phosphite is employed.

The reaction is preferably carried out at 140°–190° C, especially at 170° to 180° C, the corresponding alkyl halide $R_1Y$ or $R_2Y$, especially methyl bromide or ethyl bromide or methyl chloride or ethyl chloride, being split off.

The divalent nickel halide which is optionally co-used in the reaction if $n$ in the formula (10) is 1, is nickel-(II) bromide or especially nickel-(II) chloride.

If $Z_1$, $Z_2$, $Z_3$, $Z_4$ and $Z_5$ in the formulae (10), (12) and (13) denote an acylated hydroxyl group, and especially if $Z_7$ in the formula (14) denotes an acetyl group, the reaction gives acylated, especially acetylated, phosphorus compounds, of which the acylated, especially acetylated, hydroxyl group is hydrolysed to the free hydroxyl group.

This hydrolysis is suitably carried out in a solvent or in a solvent mixture in which the phosphorus compound obtained is soluble, under alkaline ammoniacal conditions, at the boiling point of the solvent or solvent mixture used.

The solvents or solvent mixtures employed are, for example, alkanols with 1 to 4 carbon atoms, such as methanol and especially ethanol, and/or, for example, aliphatic saturated monoketones with 3 to 6 carbon atoms, such as 2-hexanone, methyl propyl ketone, acetone or especially methyl ethyl ketone. Ethanol, or a mixture of ethanol and methyl ethyl ketone in the ratio of 1:1 are particularly suitable.

The hydrolysis is carried out in an alkaline ammoniacal medium, preferably employing aliphatic amines with 1 to 4 carbon atoms, preferably dialkylamines or trialkylamines, or mixtures of these amines, especially diethylamine.

During the hydrolysis, the corresponding aliphatic, saturated monocarboxylic acids with 2 to 5 carbon atoms, especially acetic acid, are split off.

The preparations which can be used in accordance with the process can contain, in addition to the phosphorus compound of the formula (I), at least one binder which is stable below 250° C, water and/or an organic solvent.

Suitable binders are synthetic, semi-synthetic and natural resins, and in particular both polycondensation and polyaddition products. In principle, all binders customary in the lacquer and printing ink industry can be used. The binders serve to retain the phosphorus compounds of the formula (1) on the treated position of the carrier. At the transfer temperature they should, however, not melt, not react with themselves, for example crosslink, and be capable of releasing the compound to be transferred. Preferred binders are those which, for example, dry rapidly in a warm stream of air and form a fine, preferably non-tacky, film on the carrier. As examples of suitable water-soluble binders there may be mentioned: alginate, tragacanth, carubin (from carob bean flour), dextrin, etherified or esterified vegetable mucins, carboxymethylcellulose or polyacrylamide, whilst as binders soluble in organic solvents there may be mentioned cellulose esters, such as nitrocellulose or cellulose acetate and especially cellulose ethers, such as methylcellulose, ethylcellulose, propylcellulose, isopropylcellulose, benzylcellulose or hydroxyethylcellulose as well as their mixtures. Particularly good results are achieved with ethylcellulose.

As organic solvents it is possible to use water-miscible or water-immiscible organic solvents or solvent mixtures of boiling point below 150° C, preferably below 120° C, under normal pressure. Advantageously, aliphatic, cycloaliphatic or aromatic hydrocarbons, such as toluene, cyclohexane, or petroleum ether, lower alkanols, such as methanol, ethanol, propanol, isopropanol, esters of aliphatic monocarboxylic acids, such as ethyl acetate or propyl acetate, aliphatic ketones, such as methyl ethyl ketone and halogenated aliphatic hydrocarbons, such as perchloroethylene, trichloroethylene, 1,1,1-trichloroethane or 1,1,2-trichloro-2,2,1-trifluoroethylene are used. Particularly preferred solvents are lower aliphatic esters, ketones or alcohols, such as butyl acetate, acetone, methyl ethyl ketone, ethanol, isopropanol or butanol, as well as their mixtures, for example a mixture of methyl ethyl ketone and ethanol in the rato of 1:1. The desired viscosity of the printing pastes can then be obtained by adding the stated binders together with a suitable solvent.

The weight ratio of the individual components in the preparation can vary greatly and is, for examle, from 20 to 100 per cent by weight in the case of the compounds of the formula (1), from 0 to 30 per cent by weight in the case of the binder, and from 0 to 70 per cent by weight in the case of water or the organic solvent or solvent mixture, relative to the total weight of the preparation. The amounts of compound, to be transferred to the fibre material, applied to the temporary carrier can be, for example, 10 to 100 g, preferably 15 to 40 g, per $m^2$ of carrier.

The preparations which can be used according to the invention are prepared by dissolving or finely dispersing the phosphorus compound of the formula (1) in water and/or organic solvent, advantageously in the presence of a binder which is stable below 250° C.

Further, it is also possible, and also particularly advantageous, to apply compounds of the formula (1) direct as such onto the carrier, that is to say without adding solvent or binder, for example by spraying, doctoring, pouring or sprinkling.

The process according to the invention is suitably carried out by applying the preparations to an inert temporary carrier, bringing the treated side of the carrier into contact with the fibre material which is to be treated, subjecting the carrier and the fibre material to the action of heat at not less than 80° C, preferably not less tha 130° C, and separating the fibre material from the carrier.

The temporary carrier required in accordance with the proess can be endless or be matched to the textile shapes which are to be treated, that is to say cut into shorter or longer pieces. As a rule it has no affinity for the preparation used. Suitably, the carrier is a flexible, preferably dimensionally stable, band, a strip or a film, preferably having a smooth surface, which is stable to heat and can consist of materials of the most diverse kind, for example metal, such as an aluminum foil or steel foil, plastic, paper or textile sheet-like structures, such as woven fabrics, knitted fabrics or fleeces which can optionally be coated with a film of vinyl resin, ethylcellulose, polyurethane resin or polytetrafluoroethylene.

Suitably, flexible aluminum foils, sheets of glass fibre fabric or above all sheets of paper are used.

After the preparations have been applied to the carrier, they are dried, for example by means of a warm stream of air or by infra-red irradiation, the solvent used optionally being recovered.

The treated sie of the carrier is thereupon brought into close contact with the surface to be dyed of the fibre material, and the combination is subjected to a heat treatment at not less than 80° C and preferably 150° to 220° C, particularly 150° to 200° C.

These temperatures are maintained for a sufficient period of time, preferably 5 to 120 seconds, until the flameproofing agent has been transferred to the fibre material to be treated.

Changes in temperature and in time can result in corresponding changes in the amount of coating for the same chemicals presented. It is therefore possible to regulate the transfer of the chemicals to the fibre material, and hence the amount of coating, through regulating the temperature and the transfer time.

The exposure to heat can be effected in various known ways, for example by means of a heating plate or by passing through a tunnel-shaped heating zone or over a hot heating drum, advantageously in the presence of an unheated or heated counter-roller which exerts pressure, or through a hot calendar, or by means of a heated plate (iron or warm press), optionally in vacuo, the heating devices being preheated to the requisite temperature by steam, oil or infra-red radiation or being located in a preheated chamber. After completion of the heat treatment, the textile goods are separated from the carrier.

Preferably, in addition to natural fibre materials such as cellulose, synthetic fibre materials are treated in accordance with the invention, such as, for example, cellulose ester fibre, such as cellulose 2½-acetate and triacetate fibres, especially synthetic polyamide fibres, for example those from poly-ε-caprolactam (nylon 6), from polyhexamethylenediamine adipate (nylon 6,6) or from poly-ω-aminoundecanoic acid (nylon 7), polyurethane or polyolefine fibers, for example polypropylene fibres, acid-modified polyamides, such as polycondensation products of 4,4′-diamino-2,2′-diphenyldisulphonic acid or 4,4′-diamino-2,2′-diphenylalkanedisulphonic acids with polyamide-forming starting materials, polycondensation products of monoaminocarboxylic acids or their amide-forming derivatives or of dibasic carboxylic acids and diamines with aromatic dicarboxysulphonic acids, for example polycondensation products of ε-caprolactam or hexamethylenediammonium adipate with potassium 3,5-dicarboxybenzenesulphonate, or acid-modified polyester fibres, such as polycondensation products of aromatic polycarboxylic acids, for example terephthalic acid or isophthalic acid, polyhydric alcohols, for example ethylene glycol and 1,2- or 1,3-dihydroxy-3-(3-sodium sulphopropoxy)-propane, 2,3-dimethylol-1-(3-sodium-sulphopropoxy)-butane, 2,2-bis-(3-sodium-sulphopropoxyphenyl)-propane or 3,5-dicarboxybenzene sulphonic acid or sulphonated terephthalic acid, sulphonated 4-methoxybenzenecarboxylic acid or sulphonated diphenyl-4,4′-dicarboxylic acid.

Preferably, however, fibre material of polyacrylonitrile or acrylonitrile copolymers and above all linear polyester fibres, especially of polyethylene glycol terephthalate or poly-(1,4-cyclohexanedimethylol) terephthalate, are used. If acrylonitrile copolymers are used, the proportion of acrylonitrile is suitably at least 50% and preferably at least 85 per cent by weight of the copolymer. The comonomers used are normally other vinyl compounds, for example vinylidene chloride, vinylidene cyanide, vinyl chloride, methacrylates, methylvinylpyridine, N-vinylpyrrolidone, vinyl acetate, vinyl alcohol, acrylamide or styrenesulphonic acids.

These fibre materials can also be used as mixed fabrics, the fibre materials being mixed with one another or with other fibres, examples being mixtures of polyacrylonitrile/polyester, polyamide/polyester, polyester/viscose and polyester/wool.

The fibre material can be in the most diverse states of processing, for example in the form of flocks, tow, yarn, texturised filaments, woven fabrics, knitted fabrics, fibre fleeces or textile floor coverings, such as especially needle-punched felt carpets, pile carpets or bundles of yarn.

The preparations which can be used according to the invention are applied to the temporary carrier by, for example, whole-area or partial spraying, coating or printing.

The temporary carriers can also be treated on both sides or, if appropriate, on the back, and unequal concentrations of the coatings can be selected for the two sides.

In the manufacturing instructions and examples which follow, percentages are percentages by weight.

MANUFACTURING INSTRUCTIONS

A. Compound of the formula (9.2)

23.1 g of 5-bromo-2-hydroxy-benzoic acid methyl ester and 0.5 g of nickel-(II) chloride are heated to 170° C, while stirring. 16.6 g of triethyl phosphite are then added dropwise at this temperature. The solution first turns deep blue-violet and then the reaction commences, with vigorous foaming, the ethyl bromide formed being evolved. The reaction is complete with no further ethyl bromide escapes. 15.1 g of the compound of the formula (9.2), which distils at boiling point 0.01 mm Hg = 129 to 131° C, are obtained.

$C_{12}H_{17}O_6P$ —
Analysis: Calculated : C 50.0%, H 5.94%, P 10.73%.
Found : C 49.88%, H 5.87%, P 10.55%.

B. Compound of the formula (9.3)

20.1 g of 5-chloromethyl-2-hydroxy-benzoic acid methyl ester are heated as a melt to 100° C and 16.6 g of triethyl phosphite are slowly added at this temperature over the course of 50 minutes; towards the end of the dropwise addition an exothermic reaction, with a temperature rise of about 10° C, can be observed, which ceases after addition of the triethyl phosphite. The reaction mixture is subsequently further heated to 140° C and is kept at this temperature for 1 hour, during which the initially colourless reaction mixture assumes a slight yellowish discolouration. 25.0 g of the compound of the formula (9.3) are obtained.

$C_{13}H_{19}O_6P$—
Analysis: Calculated : C 51.66%, H 6.25%, P 10.58%.
Found : C 51.62%, H 6.34%, P 10.25%.

C. Compound of the formula (9.4)

50.15 g of 5-chloromethyl-2-hydroxy-benzoic acid methyl ester are heated as a melt to 100° C, and 31 g of trimethyl phosphite are added sufficiently slowly that the temperature does not rise above 110° C. After addition of the trimethyl phosphite, the reaction mixture is further heated to 160° C and is kept at this temperature for 1 hour. The compound of the formula (9.4) is distilled as a crude product at 0.01 mm Hg, only the fraction distilling at 147° C being collected, as a slightly turbid oil of refractive index $n_{20°\ C}$ 1.5292.

$C_{11}H_{15}O_6P$ —
Analysis: Calculated : C 48.18%, H 5.51%, P 11.30%.
Found : C 47.88%, H 5.44%, P 11.12%.

D. Compound of the formula (9.5)

29.1 g of 2acetyl-5-bromo-diphenyl and 0.5 g of nickel-(II) chloride are heated to 170° C, whilst stirring. 16.6 g of triethyl phosphite are added to this suspension at 170° C over the course of 1 hour. The reaction commences, with vigorous foaming, immediately after the start of the addition of the triethyl phosphite and the reaction mixture assumes a blue-violet colour. The addition of triethyl phosphite is regulated in such a way that the ethyl bromide formed by the reaction distils off without delay. After the addition, the reaction mixture is kept at 170° C for approx. 30 minutes, until no further ethyl bromide distils.

The reaction product is then purified by vacuum distillation. 21.8 g of 2-acetyl-diphenyl-5-phosphonic acid diethyl ester are obtained in the form of a clear, colourless, oil distillate (boiling point 122°–126° C at 0.08 mm Hg).

2-Acetyl-diphenyl-5-phosphonic acid diethyl ester, thus obtained, 7.7 g of diethylamine and 4.5 g of ethanol are kept at the reflux temperature for 1 hour. Thereafter the by-products (triethylamine and acetic acid) are removed from the dark brown, oily reaction mixture by distillation at 0.05 mm Hg. The yellow crystalline distillation residue is twice recrystallised from carbon tetrachloride. 12.1 g of the compound of the formula (9.5) are obtained as white, crystalline needles. Melting point 156° C.

$C_{16}H_{19}O_4P$—
Analysis: Calculated : C 62.74%, H 6.25%, P 10.22%.
Found: C 61.9%, H 6.3%, P 10.3%.

E. Compound of the formula (9.6)

50.0 g of 3-ethyl-benzyl chloride are heated to 120° C and 53.7 g of triethyl phosphite are added over the course of 2 hours, in the course of which gaseous ethyl chloride formed by the reaction is evolved. After completion of the addition of triethyl phosphite, the reaction mixture is further heated to the reflux temperature of 140° C and kept under reflux for 15 hours. The crude product is then purified by vacuum distillation. 56.2 g of the compound of the formula (9.6) are obtained as distillate. (Boiling point 120° C at 0.1 mm Hg).

$C_{13}H_{21}O_3P$ —
Analysis: Calculated: C 60.92%, H 8.30%, P 12.08%.
Found: C 61.17%, H 8.37%, P 12.00%.

F. Compound of the formula (9.7)

54 g of 3-methoxy-benzyl chloride are heated to 120° C and 57.3 g of triethyl phophite are added over the course of 45 minutes, during which time gaseous ethyl chloride formed by the reaction is evolved. After completion of the addition of triethyl phosphite, the reaction mixture is further heated to 190° C. Thereafter, 5 g of unreacted triethyl phosphite are removed from the reaction mixture at 22° C and 0.1 mm Hg. 76 g of the compound of the formula (9.7) are obtained as a distillation residue, which is in the form of a pale yellowish liquid.

$C_{12}H_{19}O_4P$ —
Analysis: Calculted: C 55.81%, H 7.42%, P 11.99%.
Found : C 56.78%, H 7.32%, P 11.12%.

G. Compound of the formula (9.8)

97.9 g of 3-chloro-benzyl chloride are heated to 120° C and 100.1 g of triethyl phosphite are added at this temperature over the course of 45 minutes, during which time gaseous ethyl chloride formed by the reaction is evolved. After the addition, the reaction mixture is kept for 15 hours at the reflux temperature, the latter rising gradually from 130° to 170° C. Unreacted triethyl phosphite is then removed from the reaction mixture at 25° to 50° C and 0.04 mm Hg. 111 g of the compound of the formula (9.8) are obtained as a distillation residue, which is in the form of a clear liquid.

$C_{11}H_{16}O_3Cl$ P—
Analysis: Calculated: C 50.30%, H 6.14%, Cl, 13.50%, P 11.79%.
Found : C 49.35%, H 6.06%, Cl, 14.66%, P 11.24%.

EXAMPLE 1

12 g of the compound of the formula (9.2) are applied to a paper carrier of 1 $m^2$ surface area.

The carrier is placed with the coated side downwards on top of a polyester woven fabric (120 $g/m^2$). The carrier and the fabric are packaged in an aluminium foil and exposed to a heat treatment at 195° C for 25 seconds. The carrier and the fabric are then separated from one another. The polyester fabric proves to have a flameproof finish according to DIN 53,906 (ignition time 3 seconds), in contrast to the untreated fabric. The tear length is 7 cm and the burning time is 4 seconds. The untreated test specimen burns away.

Similar results are also obtained when using one of the compounds of the formulae (9.1), (9.3), (94.) or (9.5).

EXAMPLE 2

The phosphorus compound of the formula (9.2) is applied by doctor blade or spraying into a glass fibre fabric (coating 30 g/m²). The glass fibre fabric is brought together with a polyamide woven fabric, with the coated side facing away from the latter. The carrier and the fabric are then subjected to a heat treatment at 195° C between two heated plates for 30 seconds. The glass fibre fabric is then separated from the polyamide fabric without objectionable adhesion of the layer of chemicals to the finished polyamide fabric.

The polyamide fabric is found to be flameproofed according to DIN 53,906 (ignition time 3 seconds), in contrast to the untreated fabric.

EXAMPLE 3

750 g of the product of the formula (9.2) are worked into a paste in 100 g of ethylcellulose and 350 g of a 1:1 mixture of ethanol and methyl etyl ketone, and applied to paper at the rate of 24 or 48 g/m².

The coated side of the carrier is brought into contact with a polyester knitted fabric (240 g/m²) and the combination is subjected to a heat treatment at 195° C between two heating plates for 25 seconds. The carrier and the kniited fabric are then separated from one another.

The knitted fabrics are then tested for their flame resistance according to DOC FF 3–71 ("Children's Sleepwear Test"), the test being carried out after the finishing process and also after 1, 5, 10, 20 and 40 use-type washes at 40° C in a liquor containing 4 g/l of a commercial detergent for delicate fabrics.

The result is summarised in Table 1 which follows.

Table 1

| | Coating, g/m² | Finishing TL | Finishing BT | 1 wash TL | 1 wash BT | 5 washes TL | 5 washes BT | 10 washes TL | 10 washes BT | 20 washes TL | 20 washes BT | 40 washes TL | 40 washes BT |
|---|---|---|---|---|---|---|---|---|---|---|---|---|---|
| | | Tested after | | | | | | | | | | | |
| Untreated | | 12 | 22 | 4 | 9 | 10 | 25 | 4 | 19 | Burns away | 28 | 6 | 15 |
| Treated with compound of the formula | | | | | | | | | | | | | |
| (9.2) | 24 | 5 | 2 | 7 | 2 | 6 | 2 | 5 | 1 | 5 | 1 | 5 | 1 |
| (9.2) | 48 | 5 | 0 | 7 | 1 | 4 | 2 | 5 | 1 | 5 | 1 | 5.5 | 1 |

TL : Tear length in cm
BT : Burning time in seconds

DOC FF 3–7 ("Children'Sleepwear Test") is the following flameproofing test:

5 Pieces of fabric (8.9 cm × 25.4 cm) are clamped in a test frame and dried for 30 minutes at 105° C in a circulating air drying cabinet. The pieces of fabric are subsequently conditioned in a closed vessel over silica gel for 30 minutes and then subjected to the actual flame-resistance test in a burning box. The fabrics are in each case ignited for 3 seconds with a methane gas flame, the fabrics being in the vertical position.

The test is considered to have been withstood if the average charred zone is not longer than 17.5 cm and no one sample has a charred zone of more than 25.4 cm, and the individual smouldering times are not longer than 10 seconds.

EXAMPLE 4

10 g of one of the compounds of the formulae (9.1), (9.4), (9.6), (9.7) or (9.8) are applied by doctor blade to an aluminium foil (coating: 60 g/m²).

The aluminium foil is placed on a polyacrylonitrile fibre carpet (pile weight 600 g/m²), the coated side of the foil being brought into contact with the carpet pile. The carpet backing and the uncoated side of the foil are subjected to the action of heat at 200° C between two heated plates for 30 seconds.

The carpet treated in this way and an untreated carpet are tested for their flame resistance according to DIN 51,960, the results being summarised in Table 2 below:

Table 2

| Carpet treated with compound of the formula | Diameter of the burning zone in cm | Burning time in minutes |
|---|---|---|
| (9.1) | 6.5 | 3 |
| (9.4) | 5 | 3 |
| (9.6) | 5 | 3 |
| (9.7) | 5 | 3 |
| (9.8) | 5 | 3 |
| Untreated carpet | Burns away completely | 6 |

EXAMPLE 5

Instead of a polyester woven fabric, a polyamide woven fabric (240 g/m²) is finished with one of the compounds of the formulae (93), (97) or (98) in the manner indicated in Example 1 The results of the DIN 53,906 test (ignition time 3 seconds) are summarised in Table 3below.

Table 3

| Polyamide fabric finished with compound of the formula | Burning time in seconds | Tear length in cm |
|---|---|---|
| (9.3) | 12 | 7 |
| (9.7) | 8 | 10 |
| (9.8) | 5 | 7 |
| Polyamide fabric without finish | 23 | Burns away completely |

We claim:

1. Process for flameproofing organic fiber material by the dry thermal transfer process which comprises applying to an inert carrier a preparation containing a phosphorus compound of the formula

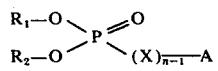

wherein $R_1$ and $R_2$ each are alkyl with 1 to 6 carbon atoms, X is alkylene with 1 to 4 carbon atoms and A is phenyl, or phenyl substituted by hydroxyl, alkoxy with 1 to 4 carbon atoms, alkyl with 1 to 4 carbon atoms, alkoxycarbonyl with 2 to 5 carbon atoms, phenyl or halogen, and *n* is 1 or 2, then bringing the carrier into contact with the surface of the fiber material which is to be flameproofed, thereafter subjecting the carrier and the material to be finished to a heat treatment at 150° to 220° C until the phosphorus compound has been transferred to the fiber material, and then separating the finished material from the carrier.

2. Process acccording to claim 1 which comprises applying a preparation containing a phosphorus compound of the formula

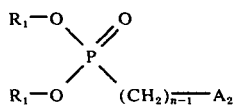

wherein $A_2$ is phenyl, hydroxyphenyl, alkoxycarbonylhydroxyphenyl or hydroxydiphenyl and $R_1$ and n have the meaning indicated in claim 1.

3. Process according to claim 2, which comprises applying a preparation containing a phosphorus compound of the formula

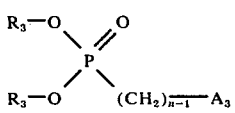

wherein $R_3$ is methyl or ethyl, *n* is 1 or 2 and $A_3$ is phenyl, 3-methoxycarbonyl-4-hydroxyphenyl or 3-phenyl-4-hydroxyphenyl.

4. Process according to claim 1, which comprises applying a preparation containing a phosphorus compound of the formula

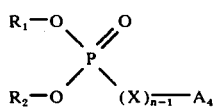

wherein $R_1$ and $R_2$ each are alkyl with 1 to 6 carbon atoms, X is alkylene with 1 to 4 carbon atoms and $A_4$ is phenyl substituted by hydroxyl, alkoxy with 1 to 4 carbon atoms, alkyl with 1 to 4 carbon atoms, alkoxycarbonyl with 2 to 5 carbon atoms, phenyl or halogen, and *n* is 1 or 2.

5. Process according to claim 4, which comprises applying a preparation containing a phosphorus compound of the formula

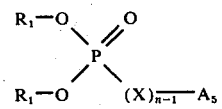

wherein $A_5$ is phenyl substituted by hydroxyl or alkoxycarbonyl with 1 to 5 carbon atoms and $R_1$, X and n have the meaning indicated in claim 4.

6. Process according to claim 5 which comprises applying a preparation containing a phosphorus compound of the formula

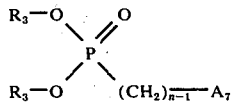

wherein $R_3$ is methyl or ethyl, *n* is 1 or 2 and $A_7$ is 3-methoxycarbonyl-4-hydroxyphenyl or 3-phenyl-4-hydroxyphenyl.

7. Process according to claim 6 which comprises applying a preparation containing the phosphorus compound of the formula

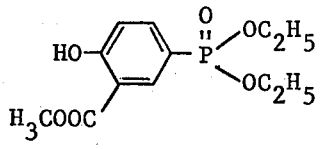

8. Process according to claim 7 which comprises applying a preparation containing, in addition to the phosphorus compound, a binder which is stable below 250° C and an organic solvent.

9. Process according to claim 1 which comprises applying a preparation containing from 20 to 100 per cent by weight of phosphorus compound 0 to 30 per cent by weight of a binder which is stable below 250° C and 0 to 70 per cent by weight of an organic solvent.

10. Process according to claim 1 which comprises flameproofing polyamide fibers, polyacrylontrile fibers or linar polyester fibers.

11. The organic filber material bearing thereon a flameproofing finish applied according to the process of claim 1.

* * * * *